United States Patent [19]

Hesselbart

[11] Patent Number: 5,013,044

[45] Date of Patent: May 7, 1991

[54] TRAINING DEVICE FOR GOLFERS

[76] Inventor: Frank C. Hesselbart, 1059 Craig Rd., Maumee, Ohio 43537

[21] Appl. No.: 615,501

[22] Filed: Nov. 19, 1990

[51] Int. Cl.[5] ..... A63B 69/36

[52] U.S. Cl. ..... 273/186 C; 273/191 R; 273/187 R

[58] Field of Search ..... 273/186 R, 186 C, 186 D, 273/191 R, 191 A, 191 B, 192, 187 R

[56] References Cited

U.S. PATENT DOCUMENTS

| | | | |
|---|---|---|---|
| 4,659,084 | 4/1987 | Vuick | 273/190 R |
| 4,699,384 | 10/1987 | Bechler | 273/191 R |
| 4,718,674 | 1/1988 | Henry | 273/191 R |
| 4,736,952 | 4/1988 | Taft et al. | 273/187 R |

*Primary Examiner*—George J. Marlo
*Attorney, Agent, or Firm*—Marshall & Melhorn

[57] ABSTRACT

The invention comprises a method and apparatus for developing proper stance, swing plane and alignment in golfers. An adjustable, generally rectangular base framework adapted to rest upon a suitable practice surface, either indoors or outdoors, includes an elongated base bar having adjustably connected therealong a target line bar and a feet and shoulder alignment bar. A ball reference bar is affixed to the alignment bar of the remote end thereof. A support shaft extends vertically upward from the base bar intermediate the target line and alignment bars. A swing plane rod adjustably carried by the support shaft is adapted for movement to selected vertical positions along the support shaft, as well as for swinging movement about the support shaft in planes parallel to the practice surface. An indicating device is provided for indicating the angular position of the swing plane rod relative to the base bar.

19 Claims, 2 Drawing Sheets

TRAINING DEVICE FOR GOLFERS

BACKGROUND OF THE INVENTION

The present invention relates generally to perfecting the club swing plane, body alignment and stance of golfers. More particularly, it pertains to apparatus comprising a novel system of interrelated components which cause the user of the apparatus to retrain his or her swing, alignment and stance so as to eliminate the cause of slicing and pull hooking.

Correct alignment and swing plane are essential for achieving accuracy in a golfer s stroke and are in turn. instrumental in assuring the golfer's satisfaction and enjoyment of the game. Normally, a golfer's training consists of verbal instruction by a colleague or instructor and actual trial and error hitting of balls on a golf course or at a driving range. To acquire a high level of proficiency a golfer must spend many hours in training. Factors such as time, money, convenience, and access to facilities often times make playing a round of golf, or even practicing at a driving range, impracticable.

Many golfers, both novice and experienced, wish to improve their game even though they may be unable to spend a prolonged period at the golf course. Other golfers particularly those in the novice category, desire to improve their game away from the watchful eye of other golfers by correcting a faulty swing which has resulted in errant shots, lost balls and a general sense of embarrassment. Still other golfers, who by regular practice have reached a plateau in their level of play, may benefit from using new training equipment to enable them to reach new levels of skill on the golf course.

The prior art is replete with patents disclosing devices purporting to remedy various deficiencies in a golfer's technique. For example, one group of patents, as typified by U.S. Pat. Nos 3,041,075, 3,229,981, 3,253,830 4,164 352, 4,248,431, 4,257,608, 4,563,010, and 4,784,393 suggests golfing aids which enable a golfer to achieve the proper feet and ball positioning Another group, including U.S. Pat. Nos. 1,854,392, 4,583,738, 4,699,384, and 4,825,743, suggests apparatus and methods for teaching a golfer to properly swing a golf club along a predetermined path within a desired swing plane. Still others, such as U.S. Pat. Nos. 4,718,674 and 4,736,952, pertain to devices purporting to teach the user both a proper stance and a correct swing alignment.

While numerous devices have been proposed over the years for improving various aspects of a player's game, none has proven entirely satisfactory in coordinating the stance, swing plane and alignment, and instilling in the golfer an inherent sense of the proper relationship between these factors. This deficiency in the prior art is remedied by the present invention.

SUMMARY OF THE INVENTION

In accordance with the invention there is provided apparatus for stance, alignment and swing plane training for use by either right-handed or left-handed golfers. The apparatus can be readily disassembled or collapsed for transport and reassembled for subsequent use. More particularly, the invention comprises an adjustable, generally rectangular base framework adapted to rest upon a suitable practice surface such as the ground. The base framework is comprised of an elongated base bar having removably connected thereto at opposite ends a target line bar and a feet and shoulder alignment bar. The target line bar and alignment bar are adapted to be affixed at selected positions along the base bar to accommodate golfers of differing heights and physiques using clubs of different lengths. There is affixed to the feet and shoulder alignment bar at the end opposite the base bar a ball reference bar to assist in properly positioning the ball. Intermediate its ends the feet and shoulder alignment bar is provided with a hinged joint, permitting the portion of the bar remote from the base bar to be pivoted in the plane of the base framework to selected angular positions for determining proper positioning of the feet of a particular golfer using a specific club.

A support shaft extends vertically upward from the base bar intermediate its ends. A swing plane rod is carried by the support shaft so as to extend perpendicular thereto, that is parallel to the ground or practice surface. The swing plane rod is adapted for movement to selected vertical positions along the support shaft as well as for swinging movement about the support shaft in a plane parallel to the practice surface. Index means is provided for indicating the angular position of the swing plane rod relative to the base bar.

It is thus an object of the invention to provide a relatively inexpensive device for promoting correct club swing plane, stance and body and ball alignment by golfers Another object of the invention is to provide such a device which will retrain a golfer's swing and eliminate the cause of slicing and pull hooking.

Another object of the invention is to provide such a device which is of relatively simple construction and which can be used by both right-handed and left-handed golfers.

Another object is to provide such a device which can be readily collapsed or disassembled so as to be carried with the golfer for use at his or her convenience.

Another object of the invention is to enable a golfer to practice body alignment and swing plane orientation with or without the use of a golf ball.

Still another object of the invention is to enable a golfer to practice either indoors or outdoors.

Yet another object of the invention is to provide a device functional at selected heights for coordinating body movement to assist the golfer in retraining his or her hand, arm and shoulder motion for developing proper shoulder rotation and consequently establishing a correct club swing plane.

BRIEF DESCRIPTION OF THE DRAWINGS

The above, as well as other advantages of the present invention, will become readily apparent to those skilled in the art from the following detailed description of a preferred embodiment when considered in the light of the accompanying drawings, in which.

DESCRIPTION OF THE PREFERRED EMBODIMENT

Figure 1:
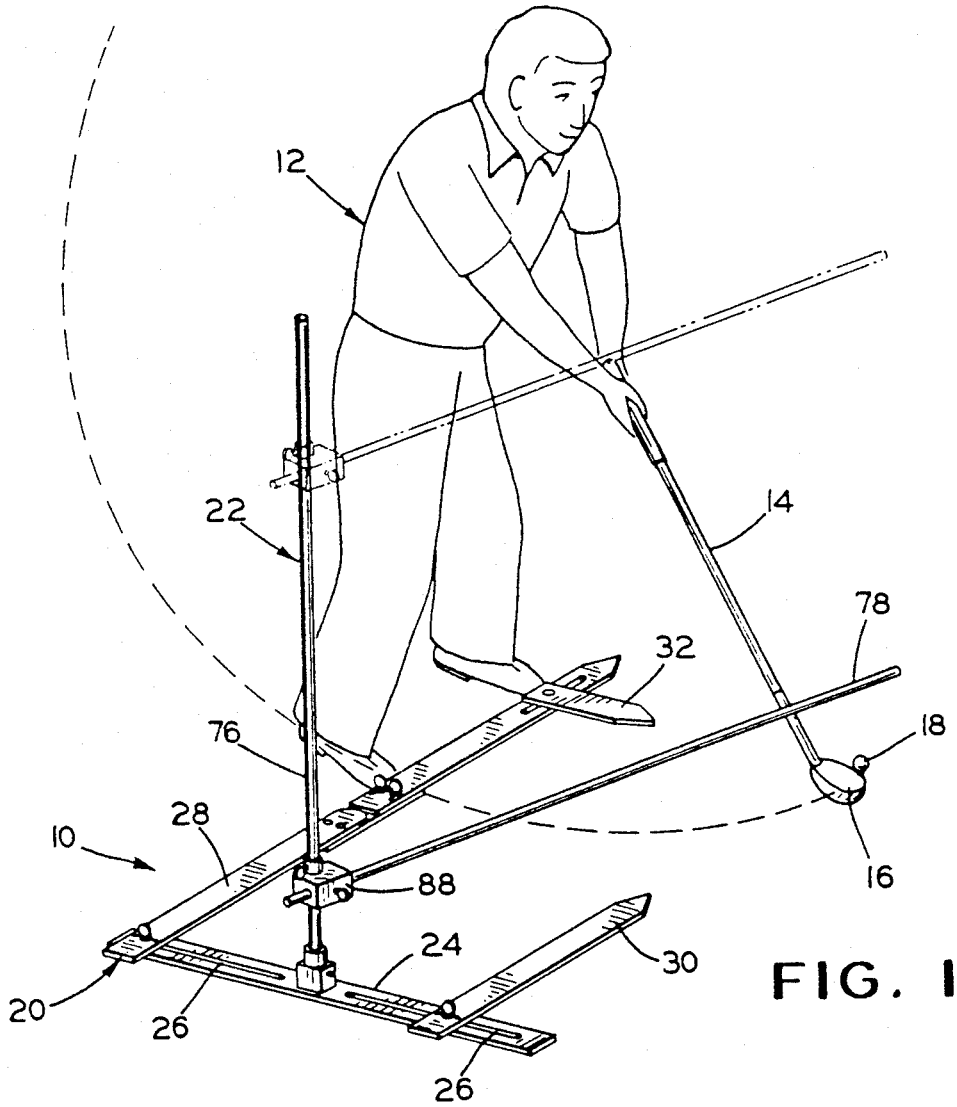
FIG. 1 is a perspective view of a golf swing plane, stance and alignment training apparatus in accordance with the invention, illustrating its manner of use by a golfer.

Turning now to the drawings, and in particular to FIG. 1, there is shown generally at 10 a golf training apparatus embodying the invention, with a right-handed golfer 12 in position adjacent the apparatus and holding a golf club 14 having a head 16 for striking a golf ball 18 positioned on the surface in the proper location dictated by the training apparatus as will be hereinafter described. The training apparatus comprises a generally rectangular base 20 adapted to be placed upon the ground as at the user's residence, or upon a suitable supporting surface of an appropriate training facility such as a driving range, gym or other indoor facility A swing plane component 22 is supported by the base in an upright position.

Where the device is being used outdoors as in the yard or at a driving range, the ball 18 may be a conventional golf ball. However, where space is limited, the device may nevertheless be employed in developing the correct techniques by using a ball 18 of the so-called whiffle ball type, in place of the conventional golf ball or, it may be used without a ball for developing a proper swing.

The base framework 20 includes a base bar 24 which may be of rectangular bar stock. The base bar, as well as the other components, are preferably formed of a light-weight metal such as aluminum, or a durable, rigid plastic. Other suitable materials such as a rigid fiber-glass-reinforced pultrusion material of polyester or other thermosetting resin matrices may likewise be employed. The base bar includes elongated longitudinally extending openings 26 therein by means of which an alignment bar 28 and a target line bar 30 are adjustably connected to the base bar. A ball reference bar 32 is pivotally attached to the alignment bar 28 at its end remote from the base bar 24.

Figure 6:
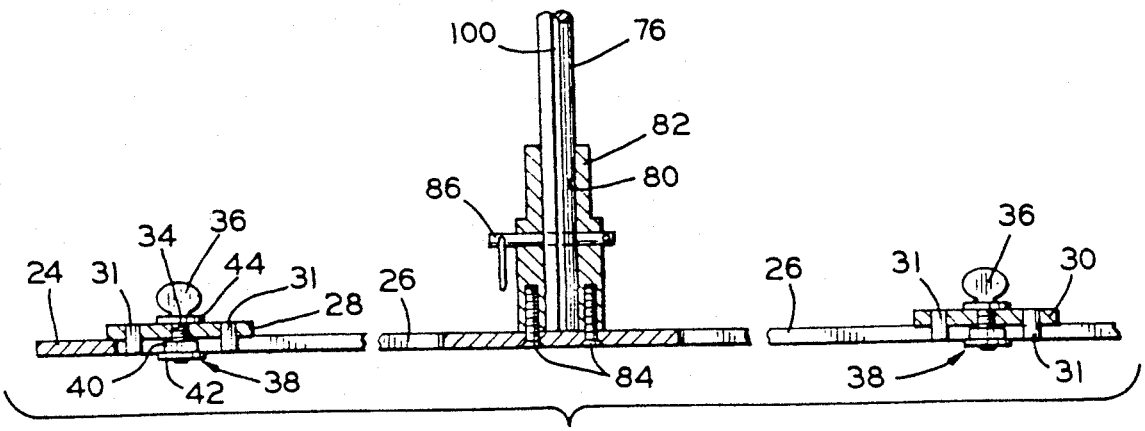
FIG. 6 is a enlarged fragmentary sectional view taken substantially along line 6—6 of FIG. 3.

The base bar 24, alignment bar 28 and target line bar 30 serve to establish the desired direction of the ball upon impact with the club head and the correct orientation of the golfer's body in swinging the club and addressing the ball to achieve the proper flight direction. It has been determined that the target line bar and alignment bar should be perpendicular to the base bar and movable to selected positions therealong to accommodate golfers of various statures, and different club selections, as will be hereinafter explained. To that end, and to enable the members to be readily attached to and removed from the base bar, the alignment and target line bars are provided with similar connecting means for enabling either bar to be securely affixed to the base bar at any selected position along either of the elongated openings 26, with the assurance that they will be perpendicular to the base bar. Thus, as best seen in FIG. 6, each of the bars 28 and 30 includes a pair of spaced pins 31 projecting from the respective bars along a line transverse to the longitudinal axes of the bars. The pins are adapted to be received within the slots 26. Aligned with and intermediate each pair of pins is an opening 34 through which a threaded fastener 36 such as a thumbscrew rotatably extends. The fastener extends into the opening or slot 26 to be threadably received in a captive nut 38 positioned within the slot. The captive nut may comprise, for example, a square or rectangular body 40 received between the opposite sidewalls of the slot, and a washer 42 affixed to the body 40 and extending beyond the side edges of the elongated opening to bear against the lower surface of the base bar 24. A collar 44 is provided on the fastener 36 for similarly bearing against the upper surface of the bar 28 or 30. As will be readily apparent, the alignment bar 28 and target line bar 30 may thus be readily affixed at any selected position along the elongated openings 26 with assurance that they will be oriented perpendicular to the base bar 24.

It is known that for the ball to travel along the target line from the point of impact with the club to the target, the face of the club must be perpendicular to the target line at the point of impact with the ball. To accomplish this, for most golfers the shoulders, hips and feet should be parallel to the target line as the golfer assumes his or her stance in preparation for addressing the ball. However, it has been found that in certain instances due to various factors such as stance, physique and club selection, the golfer may need to make a slight adjustment in orientation in preparing to address the ball. For example, the golfer would normally assume a basically square stance when using a five iron, a progressively open stance for six irons up through wedge, and a progressively closed stance for four irons down through driver. In order to allow the device to be used by different people, and to permit a particular golfer to consistently assume the correct orientation and to enable him or her to repeat the correct orientation from one training session to the next, the outer segment of the alignment bar 28 is preferably constructed so as to be adjustable to selected angular positions relative to the base bar 24.

Figure 3:
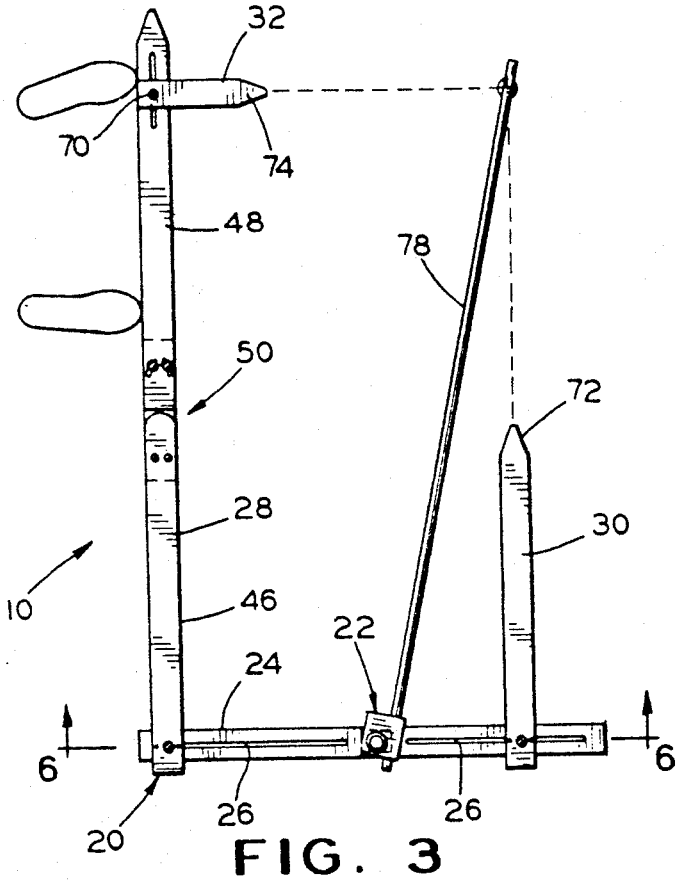
FIG. 3 is a top view of the apparatus shown in FIG. 1.
Figure 4:
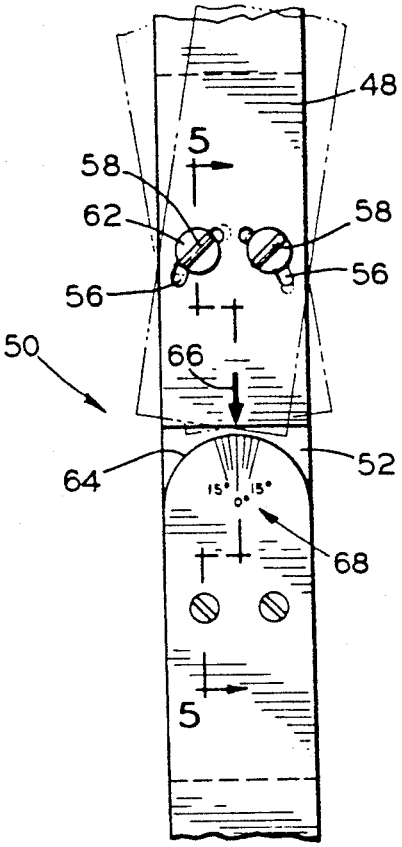
FIG. 4 is an enlarged fragmentary top view of the hinge portion of the feet shoulder alignment bar.
Figure 5:
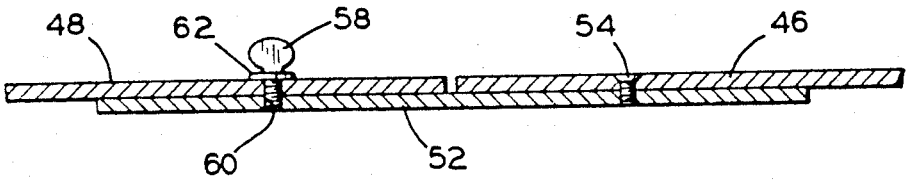
FIG. 5 is a sectional view of the apparatus taken substantially along line 5—5 of FIG. 4.

To that end, as best seen in FIGS. 3, 4 and 5, the alignment bar 28 may advantageously comprise a fixed inner segment 46 and a swingable outer segment 48 interconnected by a pivotable coupling mechanism 50. In the coupling mechanism, the adjacent ends of the inner and outer segments 46 and 48 are interconnected by a splice plate 52. The splice plate is affixed to the inner segment as by a pair of screw members 54 extending through the segment and threaded into the splice plate. The outer segment 48 is provided with a pair of angularly oriented arcuate slots 56 through which thumb screws 58 extend and are threaded into openings 60 in the splice plate. The thumb screws include collars 62 adapted to bear against the upper surface of the outer segment 48 as the thumb screws are tightened down. The inner segment 46 is formed with a rounded end as at 64 so that with the thumb screws appropriately loosened, the outer segment 48 may, by utilizing the slots 56, be swung to selected angular positions in either direction as shown in broken lines in FIG. 4. In order to indicate the particular angular relationship between the members, the outer number 48 may be provided on its upper surface with an indicia such as an arrow 66 aligned with its longitudinal axis, and adapted to cooperate with a scale 68 formed on the upper surface of the fixed inner segment 46. The scale 68 may, for example, be graduated in five degree increments in each direction from a median zero point. Thus, as will be readily apparent by loosening the thumb screw 58, the outer segment 48 may be swung in an arc about the end of the fixed inner segment 46, with the angular relationship being indicated by the arrow 66 and scale 68, and then secured in a selected position by tightening down the thumbscrews 58.

As indicated hereinbefore, there is affixed at the outer end of the swingable segment 48 of the alignment bar 28 a ball reference bar 32 which serves to indicate, with the target line bar 30, proper placement of the ball 18 on the playing surface relative to the base 20 of the training apparatus. The ball reference bar in operative position is affixed to the segment 48, with its longitudinal axis perpendicular to that of the segment 48. In order for the ball reference bar to be adjustable along the segment 48 while remaining perpendicular thereto, and for the device to be fully collapsible for transport, the ball reference bar is preferably secured to segment 48 by means of a slotted connector of the type employed in affixing the alignment and target line bars to the base bar.

As will be apparent in FIGS. 1 and 3, the target line and ball reference bars 30 and 32 are provided with tapered ends 72 and 74, respectively, for assistance in positioning the ball. The segment 48 may likewise be provided with a tapered end. More particularly, the ball is positioned by visually determining the point of intersection of the projected center lines or longitudinal axes of the two bars with the assistance of the tapered ends 72 and 74, and placing the ball on the playing surface at the point of intersection of the projected center lines.

With the body of the golfer properly oriented by correct placement of the feet relative to the alignment bar 28 as will be hereinafter described, the golfer is enabled to develop and integrate into his or her form a proper swing for directing the ball along the desired path to the target by means of the swing plane component 22. As will be seen in FIG. 1, the swing plane component 22 of the novel training aid includes an upright member 76 mounted intermediate the ends of the base bar 24 so as to extend normal to the plane defined by the base bar, alignment bar 28 and target line bar 30 or, in other words, normal to the playing surface. Mounted upon the upright member 76 so as to be vertically adjustable therealong is a swing plane rod 78. The swing plane rod extends perpendicular to the upright member 76 and is adapted to be pivoted about the upright member to selected angular positions within planes normal to the upright member. The swing plane rod must be capable of flexing or bending if struck by the club head and then returning to its original straight condition. The rod may, for example, be a tubular member such as thin wall metal tubing having a resilient plastic jacket for preventing harm to club heads.

The upright member 76 is preferably a tubular member such as conventional thin wall tubular conduit or a so called pultruded section of fiberglass reinforced plastic and, as best seen in FIG. 6, is affixed to the base bar 24 as by being removably telescopically received within a bore 80 of a fitting 82 secured to the base bar by threaded fasteners 84 In order that the orientation of the swing plane rod 78 relative to the base 20 may be known, it is necessary that the upright member 76 assume a fixed rotary position relative to the base each time the device is assembled. Accordingly, there is provided a locking pin 86 for removable insertion through aligned openings in the fitting 82 and the upright member.

Figure 2:
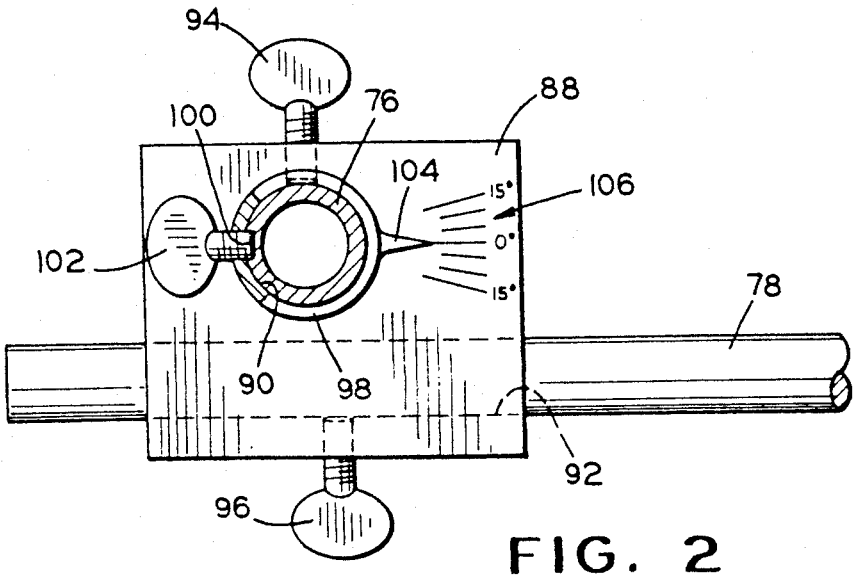
FIG. 2 is an enlarged fragmentary top view, illustrating the swing plane block of the device.

In order to establish the proper swing plane and develop in the golfer an inherent sense of that swing plane in relation to his or her stance and feet and shoulder alignment,. in accordance with the invention, the swing plane rod 78 is adapted to be moved up and down along the upright Member 76 as well as to be swung in an arc about the member. To that end, there is provided a mounting block 88, as best seen in FIGS. 1 and 2, for affixing the swing plane rod to the upright member. A first opening 90 extends through the mounting block in one direction for slidingly receiving the upright member 76 therein, while a second opening 92 extends through the block offset from and perpendicular to the first opening for slidingly receiving the swing plane rod 78 therethrough. A first wing set screw 94 threaded through the block is adapted to bear at its end against the outer surface of the upright member and secure the block to the upright member at selected linear positions therealong, as well as at selected rotational positions relative to the upright member. A second wing set screw 96 threaded through the block is adapted to axially bear against the swing plane rod 78, securing the rod at selected axial and/or rotational positions relative to the block.

In order to visually indicate the angular orientation of the swing plane rod relative to the rectangular base 20, a slidable collar 98 is provided on the upright member 76 above the mounting block 88. A longitudinally extending groove 100 is formed in the outer surface of the upright member. preferably along a line displaced 90°, from the longitudinal axis of the locking pin 86. A third wing set screw 102 is threaded through the collar 98 so that its forward end may be received in the longitudinal groove to assure a predetermined orientation of the collar relative to the upright member 76, and thus to the base bar 24. The set screw 102 may be loosened to permit the collar to be moved along the upright member with the mounting block, and tightened to secure it at selected positions therealong. A pointer 104 on the collar 98 cooperates with a scale 106 provided on the top surface of the mounting block 88 to provide a visual indication of the angular orientation of the swing plane rod 78 relative to the bars 24, 28 and 30. Each line on the scale may, for example represent an angular displacement of five degrees, so that the scale 106 as illustrated in FIG. 2 would define an angular displacement of up to fifteen degrees in either direction from the center or zero displacement mark. In other words, with the pointer 104 aligned with the center mark of the scale, the swing plane rod 78 would be parallel to the alignment bar 28 and the target line bar 30. The scale may be graduated so that with the pointer 104 it will indicate angular displacement of the swing plane rod in either direction from this position in increments of, for example, five degrees up to a total of fifteen or more degrees.

Turning now to a brief review of the manner of using the novel device, the apparatus is set up as appropriate for either a right-handed or left-handed golfer, that is, with the alignment and target line bars 28 and 30 positioned as shown in FIG. 1 for a right-handed golfer or reversed for a left-handed golfer. For convenience, use of the device by a right-handed golfer as illustrated in FIG. 1, and using a driver such as a number one wood, will be described. With the body parallel to the alignment bar, the inside of the left toe is placed in line with the ball reference bar 32. The right foot is placed along the alignment bar in a natural stance, approximately shoulder width from the left foot.

The swing plane rod 78 is next set at approximately shoulder height and an angle of zero degrees on the scale 106 by appropriately moving the mounting block 88 along and rotating it relative to the upright member 76. While holding the club which is to be used in practice, the club is slowly brought back slightly inside the target line until the hands are at waist height. With the hands at waist height, the angular direction of the left arm relative to the target line is noted, and the swing plane rod angle is set to match that of the left arm. The swing plane rod is thus set for promoting the correct swing plane. The angle indicated on the scale 106 is noted and becomes a constant reference for each training session.

A ball is positioned on the playing surface beneath the tip of the swing plane rod and in line with the ball reference bar as in FIG. 3. The target line bar 30 is next adjusted along the base bar 24 to the position where it is aligned with the golf ball and the target The target line bar. golf ball and target are thus aligned, and the inner segment 46 of the alignment bar 28 is parallel to the target line bar. The swingable outer segment 48 of the alignment bar can be adjusted, for example, to slightly open for short irons, square or straight for mid-irons, and slightly closed for long irons and woods, as necessary for the particular golfer.

With the club face and the body properly aligned in accordance with the alignment and target line bars, the swing plane rod serves to develop in the golfer a sense of the proper swing and to integrate the swing with the body stance and alignment so that they become instilled in the golfer as a natural routine. The proper swing plane is different for each club. Thus, the swing plane for a wedge is more upright or near vertical, while for a driver it is considerably more flat or less inclined. To that end, in order to develop proper shoulder rotation during the swing, practice is begun with the swing plane rod positioned at about shoulder height. The shoulder rotation is a combination of both horizontal and vertical movement such that the rotation on the back swing is up and around and, conversely, on the down swing is down and around. The club is swung so that the club head and shaft pass inside and beneath the swing plane rod. As the golfer develops the ability to swing the club without striking the swing plane rod, it is progressively lowered along the upright member 76 until he or she is able to so swing the club with the swing plane rod located about six inches above the playing surface. When such a swing becomes routine and feels natural to the golfer, the cause of pull hooking and slicing will have been eliminated.

It is to be understood that the form of the invention herein shown and described is to be taken as a preferred embodiment only of the same, and that various changes in the size, shape and arrangement of parts, as well as various procedural changes, may be made without departing from the spirit of the invention or the scope of the following claims:

What is claimed is:

1. A portable practice device for perfecting the stance, body alignment and club swing plane of golfers, comprising a base assembly adapted for placement upon a supporting surface on which a golfer is to practice, said base assembly including a base bar, an alignment bar extending from said base bar and along which the feet of the golfer are positioned for proper body alignment, a target line bar extending from said base bar and spaced therealong from said alignment bar, and a swing plane assembly carried by said base bar intermediate said alignment bar and said target line bar, said swing plane assembly including a support member extending upwardly from said base bar and a swing plane rod mounted on said support member and extending over said base assembly, said swing plane rod being mounted for movement along said support member to selected elevations above said base assembly and for swinging movement about said support member to selected angular positions relative to said base bar.

2. A portable practice device for perfecting the stance, body alignment and club swing plane of golfers as claimed in claim 1, including means for removably securing said alignment bar to said base bar at selected positions therealong.

3. A portable practice device for perfecting the stance, body alignment and club swing plane of golfers as claimed in claim 2, wherein said means for removably securing said alignment bar to said base bar includes means orienting said alignment bar perpendicular to said base bar at any of said selected positions.

4. A portable practice device for perfecting the stance, body alignment and club swing plane of golfers as claimed in claim 3, wherein said means for removably securing said alignment bar to said base bar comprises means defining an elongated slot extending longitudinally along said base bar, a spaced pair of pins projecting from said alignment bar for reception in said slot, and fastener means between said pins for releasably clamping said alignment means to said base bar.

5. A portable practice device for perfecting the stance, body alignment and club swing plane of golfers as claimed in claim 1, wherein said alignment bar includes an inner segment extending perpendicularly from said base bar and having an end remote from said base bar, an outer segment, and means affixing said outer segment to the remote end of said inner segment for swinging movement to selected angular positions relative to said inner segment.

6. A portable practice device for perfecting the stance, body alignment and club swing plane of golfers as claimed in claim 5, wherein said affixing means comprises a splice plate affixed to said inner segment, means swingably affixing said outer segment to said splice plate, and means releasably clamping said outer segment to said splice plate at selected angular positions relative thereto.

7. A portable practice device for perfecting the stance, body alignment and club swing plane of golfers as claimed in claim 6, wherein said means swingably affixing and releasably clamping comprises a pair of arcuate slots in said outer segment and a fastener means in each said slot for selectively clamping said outer segment to said splice plate.

8. A portable practice device for perfecting the stance, body alignment and club swing plane of golfers as claimed in claim 7, including cooperating scale means on said inner and outer segments operable to visually indicate the angular relationship between said inner and outer segments.

9. A portable practice device for perfecting the stance, body alignment and club swing plane of golfers as claimed in claim 5, including a ball reference bar affixed to said outer segment at the outer end thereof for movement to selected longitudinal positions therealong, said ball reference bar being oriented with its longitudinal axis perpendicular to said outer segment.

10. A portable practice device for perfecting the stance, body alignment and club swing plane of golfers as claimed in claim 1, including means for removably securing said target line bar to said base bar at selected positions therealong.

11. A portable practice device for perfecting the stance, body alignment and club swing plane of golfers as claimed in claim 10, wherein said means for removably securing said target line bar to said base bar includes means orienting said target line bar perpendicular to said base bar at each said selected position.

12. A portable practice device for perfecting the stance, body alignment and club swing plane of golfers as claimed in claim 11, wherein said means for removably securing said target line bar to said base bar comprises means defining an elongated slot extending longitudinally along said base bar, a spaced pair of pins projecting from said target line bar for reception in said slot, and fastener means between said pins for releasably clamping said target line bar to said base bar.

13. A portable practice device for perfecting the stance, body alignment and club swing plane of golfers as claimed in claim 1, including a fitting affixed to said base bar, said fitting including means removably telescopically receiving the lower end portion of said support member and orienting said support member substantially perpendicular to said base bar.

14. A portable practice device for perfecting the stance, body alignment and club swing plane of golfers as claimed in claim 13, including pin means removably extending transversely through said fitting and said support member for securing said support member against axial and rotational movement within said fitting.

15. A portable practice device for perfecting the stance, body alignment and club swing plane of golfers as claimed in claim 1, including a mounting block moveable along said support member to selected positions above said base, and means releasably securing said mounting block to said support member at said selected positions, said mounting block including means supporting said swing plane rod for swinging movement about said support member in a plane substantially parallel to said base.

16. A portable practice device for perfecting the stance, body alignment and club swing plane of golfers as claimed in claim 15, wherein said support member is of cylindrical cross section, said support block including a cylindrical first opening extending therethrough for receiving said cylindrical support member and means for clampingly engaging said support block to said support member.

17. A portable practice device for perfecting the stance, body alignment and club swing plane of golfers as claimed in claim 16, including a second opening extending through said block for axially slidingly receiving said swing plane rod therein, the longitudinal axis of said second opening being perpendicular to the longitudinal axis of said first opening, and means releasably clampingly engaging said swing plane rod to secure said swing plane rod at selected axial positions within said block.

18. A portable practice device for perfecting the stance, body alignment and club swing plane of golfers as claimed in claim 16, wherein said support member includes a longitudinally extending groove in its outer surface, and including pin means removably extending through said fitting and said support member for securing said support member against axial and rotational movement within said fitting with said groove in a predetermined radial position, said means for clampingly engaging said support block to said support member comprising setscrew means extending through said block for axially bearing against said support member, and including a collar surrounding said support member, said collar being axially movable along said support member with said support block, second setscrew means extending through said collar adapted to extend into said groove and bear axially against said support member for securing said collar to said support member in a predetermined rotary orientation, pointer means projecting radially from said collar, and scale means on said support block adapted to cooperate with said pointer means for visually indicating the angular relationship of said swing plane rod to said base bar.

19. A portable practice device for perfecting the stance, body alignment and club swing plane of golfers as claimed in claim 18, including a second opening extending through said support block for axially slidingly receiving said swing plane rod therein, the longitudinal axis of said second opening being perpendicular to the longitudinal axis of said first opening, and third setscrew means extending through said block for axially bearing against said swing plane rod to secure said swing plane rod at selected axial positions within said support block.

* * * * *